US006567002B2

(12) United States Patent
Manneschi et al.

(10) Patent No.: US 6,567,002 B2
(45) Date of Patent: May 20, 2003

(54) TRANSPONDER READING TRANSDUCER TO CONTROL PASSAGES

(76) Inventors: Alessandro Manneschi, 15, Via XXV Aprile, I-52100 Arezzo (IT); Giovanni Manneschi, 17, Via XXV Aprile, I-52100 Arezzo (IT)

( * ) Notice: Subject to any disclaimer, the term of this patent is extended or adjusted under 35 U.S.C. 154(b) by 0 days.

(21) Appl. No.: 09/888,602

(22) Filed: Jun. 26, 2001

(65) Prior Publication Data

US 2002/0030599 A1 Mar. 14, 2002

(30) Foreign Application Priority Data

Sep. 8, 2000 (IT) ..... AR00A0040

(51) Int. Cl.[7] ..... G08B 13/14

(52) U.S. Cl. ..... 340/572.1; 340/572.7; 340/572.8; 343/700

(58) Field of Search ..... 340/572.1, 572.7, 340/5.2, 5.6, 5.7; 343/700 MS; 235/450, 449, 439; 342/30, 42

(56) References Cited

U.S. PATENT DOCUMENTS

| | | | | | |
|---|---|---|---|---|---|
| 3,790,945 | A | * | 2/1974 | Fearon | 340/280 |
| 4,063,230 | A | | 12/1977 | Purinton et al. | 340/280 |
| 4,074,249 | A | * | 2/1978 | Minasy | 340/280 |
| 4,135,183 | A | * | 1/1979 | Heltemes | 340/572 |
| 4,135,184 | A | * | 1/1979 | Pruzick | 340/572 |
| 4,413,254 | A | * | 11/1983 | Pinneo et al. | 9/81 |
| 4,605,898 | A | | 8/1986 | Aittoniemi et al. | 324/232 |
| 4,922,261 | A | * | 5/1990 | O'Farrell | 343/742 |
| 5,005,001 | A | | 4/1991 | Cordery | 340/551 |
| 5,051,726 | A | * | 9/1991 | Copeland et al. | 340/572.7 |
| 5,061,941 | A | * | 10/1991 | Lizzi et al. | 343/742 |
| 5,130,697 | A | * | 7/1992 | McGinn | 340/551 |
| 5,414,410 | A | * | 5/1995 | Davies et al. | 340/551 |
| 5,440,296 | A | * | 8/1995 | Nelson | 340/572.7 |
| 5,459,451 | A | * | 10/1995 | Crossfield et al. | 340/572.7 |
| 5,498,959 | A | | 3/1996 | Manneschi | 361/149 |
| 5,512,878 | A | * | 4/1996 | Balch et al. | 340/572.4 |
| 5,602,556 | A | * | 2/1997 | Bowers | 343/742 |
| 5,952,922 | A | * | 9/1999 | Shober | 340/572.4 |
| 6,020,856 | A | * | 2/2000 | Alicot | 343/742 |
| 6,307,468 | B1 | * | 10/2001 | Ward, Jr. | 340/505 |
| RE37,467 | E | * | 12/2001 | Brasch et al. | 340/541 |

FOREIGN PATENT DOCUMENTS

| | | |
|---|---|---|
| EP | 0186483 | 7/1986 |
| GB | 2083978 | 3/1982 |
| IT | 1249278 | 6/1991 |
| WO | 95/33344 | 12/1995 |

* cited by examiner

*Primary Examiner*—Benjamin C. Lee
*Assistant Examiner*—Phung Nguyen
(74) *Attorney, Agent, or Firm*—Dennison, Schultz & Dougherty

(57) ABSTRACT

The invention consists of an elongated three-dimensional transducer (1), whose length is adequate to cover the areas in which the transponder that needs to be read can be placed, it is equipped with suitable means for it to be anchored to the floor, on the ceiling or on the wall near the passage that needs to be controlled, it includes at least two electric coils one of which is the transmitter (Tx) and the other one is the receiver (Rx), the first one is usually homopolar, while the second one is usually multipolar.

6 Claims, 2 Drawing Sheets

TRANSPONDER READING TRANSDUCER TO CONTROL PASSAGES

BACKGROUND OF THE INVENTION

The invention consists of a transponder reading transducer that controls passages, with which the information contained in transponders assigned to people and/or objects in transit is read.

There are existing readers of transponder inductive cards placed on walls, which can read or read and record information in transponder inductive cards, hereinafter indicated as transponders to simplify, which are placed in front of them at a distance which is not above 30–40 cm.

Said readers are used to obtain, for example, the authorisation to access special areas such as strong rooms, offices and particularly important rooms, as well as special access to parking areas, without having to open the car windows to position the transponder near them, so as to automatically open the access point. In another case they are used to allow the owner of the transponder to proceed through controlled access points without having to stop at the automatic doors, even when both his/her hands are busy, therefore even when the person cannot handle his/her transponder. To reach these results, the existing transponder readers, defined as the "Long Range" type, use flat, square, rectangular or round shaped antennas, which concentrate the flow of the magnetic field produced into one limited section lobe, which is practically on the same axis as the reader. This so as to permit a sufficient reading distance.

However, this implies that to make the transponder readable without manually positioning it in front of the corresponding reader, it must be worn by its user on a specific area of the body, corresponding in height, to that of the magnetic lobe of the reader with which it is designed to interact. Furthermore, to obtain the maximum induction coupling and therefore have a sufficiently intense reception of the signal, even when the transponder is at a distance of 30–40 cm from the reader, it must be presented with its surface parallel to that of the same reader, that is in a position that is parallel to the surface on which the transmission/reception coil or coils are placed. This implies that, as well as wearing the transponder at a specific height, the person must position his/her body so as to aim towards the transponder in parallel to the reader, in order to attain the correct reading operation. Otherwise, the person will have to extract the transponder and present it facing the reader, at a distance that is not more than the above mentioned maximum reading distance. Said features form a limitation of its use, as they slow down the access and/or transit flow, they condition the approaching direction of people to the controlled access point and prevents them from wearing the transponder in positions that are considered by each person as the most appropriate. In fact, along with the parallel position, they must also keep in account their personal height. There is also the necessity of detecting the passage of machines, apparati and objects in general in enclosed areas so as to know their exact position at any given time. For this reason said items will be supplied with a transponder device so that their movement within the controlled area can be detected, therefore tracking their movement inside the controlled area.

SUMMARY OF THE INVENTION

The aim of the present invention is to create an inductive transducer card reader and other transponder devices, which can reach a reading distance of at least 50–60 cms. to allow people and things in transit in the controlled passage who possess the card or transponder device, hereinafter called transponder for simplicity, to follow a normal route, that is without having to move close to the transponder reader and having to brush against the wall or plane on which the transponder is placed.

Another aim of the invention is to create a transponder reader which is capable of interacting with it when positioned within a widely variable height from the floor, so as not to force its possessor to keep it in a specific position or to raise or lower him/herself in correspondence to the control point depending on his/her height, and so as not to oblige the users to raise or lower the carried items to the level of the reading point.

One more aim is to create a transponder reader which is capable of reading a transponder even when it is presented on different levels from the one parallel to the wall or in any case to the level on which the transponder reader is placed, to allow the users to keep their transponders in their pocket or in their preferred position, whereas on objects, to allow placing the transponder device in the most appropriate position for the same object.

The invention which has allowed us to obtain said results translates into a transponder reading inductive transducer consisting of a three-dimensional elongated structure combined with electrical coils that are sufficiently long to cover the portions of the human body on which the transponder can be worn and the areas of the objects on which the transponder device to be read can be applied. It is furthermore furnished with the means for its anchoring to the floor, on the ceiling or on the wall close to the control passage. Its elongated structure is shaped like a small column and is combined with at least two coils, one of which is a transmitter and the other a receiver, the first one is normally homopolar, the second is usually multipolar.

This type of invention is particularly advantageous as, during the testing of the invention, the use in transmission of at least one long homopolar coil has allowed us to reach effective reading distances of at least 50–60 cms., thus allowing the possessor of the transponder and the object carrying the transponder device to proceed in a straight line along the route through the control passage, without having to move perceptibly towards the same inductive transducer, with the possible application of transponder readers placed on both sides of the controlled passage.

Another advantage derives from the fact that the inductive transponder reading inductive transducer is structured so as to jut from the sustaining wall, or it can be anchored to the floor or on the ceiling and in any case placed in a position which is close to the line or route followed by the possessors of the transponder and of the objects equipped with transponder devices when passing through the controlled passage, favouring their crossing and therefore their exchange with the lobe formed by the lines of magnetic flow issued by the same transponder reader.

Another advantage derives from the fact that the elongated shape of the inductive transducer covers at least the area bounded between the trouser pockets and the shoulder of the person who owns the transponder, even considering the possible variations in height of the users, allowing them to be traced by the transponder carried in the pocket they deem to be the most appropriate.

In the same way, in the event of objects to be controlled, the elongated shape of the inductive transducer allows us to cover the control passage for a height from the floor that is considered useful for placing the transponder device on the objects to be controlled.

A further advantage derives from the fact that the receiver coil, being normally of the multipolar type, is practically insensible to parasite magnetic fields, so that the invention can be installed even in passages that are strongly influenced by external magnetic fields produced by various sources. In fact, the parasite magnetic fields invest the total area of the inductive transducer's receiving antenna originating a practically nil signal, while those produced by the transponder only invest part of the inductive transducer's receiving antenna and therefore generate a readable signal.

A further advantage is due to the fact that the receiver coil of the inductive transducer, is capable of receiving magnetic fields produced by the transponder independently from the orientation of the body of the person wearing it or of the object on which it is applied, in respect to the same inductive transducer, this depends on the fact that the three-dimensional support, shaped for example like a small column, has a circular or other geometric shape cross section. In this way, the person or object carrying the transponder has ample freedom of movement in correspondence to the passage in which the detection is carried out.

Finally, another advantage is due to the fact that the longitudinal three-dimensional support permits the placement, for the totality or most of its length, of various transmitter coils and receiver coils, aimed and positioned at various heights from each other. This so as to obtain, each time, optimal operating and detecting, reading and writing conditions.

BRIEF DESCRIPTION OF THE DRAWINGS

The invention is described in a more detailed way here below, with reference to the schematic and exemplifying drawings reproduced in the enclosed tables, in which.

DESCRIPTION OF THE PREFERRED EMBODIMENT

Figure 1:
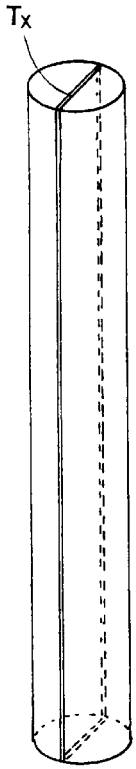
FIG. 1 is the perspective view of a supporting small column with only one homopolar transmitter coil.
Figure 2:
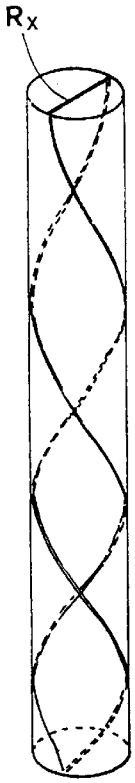
FIG. 2 is the perspective view of a supporting small column with only one multipolar receiver coil.

It is understood that the drawings are only exemplifying to allow the comprehension of the invention without constituting any limitation of it. The invention therefore relates to a transponder reader 1 to control passages, with which the transponders assigned to users or objects in transit through the controlled passage can be read from a distance.

It consists of an elongated three-dimensional supporting structure, usually shaped like a small column, the profile of the cross section being circular, or may recall an elliptical or maybe even polygonal shape on which the electric transducer coils are positioned, involving its length completely or almost completely. Its length is sufficient to cover the portions of the human body on which the transponder worn by the user can be placed, or the height from the floor involved in the transit of objects carrying said transponder. In the case of people, the length of the inductive transducer will cover at least the area comprised between the trouser pockets and the person's shoulder, considering the possible variations in height of human beings. The length of the transponder reader is usually comprised between 40 and 180 cms. approximately.

The elongated structure that supports the transducer coils is shaped like a small column and is protected on the outside by an adequate protection shell. The ends of said small column are equipped with means 2 for its support and anchorage which can be made onto the floor, on the ceiling or, more frequently, on the wall or in any case near the passage to be controlled.

Said supporting means 2 usually consist of two end supports, shaped so as to be anchored to a wall. In another solution the transponder reader is equipped with a single end support for it to be anchored onto the floor or to the ceiling or on any other horizontal plane.

The transponder reader carries at least two electrical coils of which one is the Tx transmitter and the other the Rx receiver, which end on an appropriate connector 3.

The transmitter coil is usually homopolar, while the receiver one is multipolar. The transmitter coil therefore has a rectangular shape and is considerably long to generate a sufficiently intense stimulating magnetic field on the entire area that corresponds to its cross section.

Furthermore, said magnetic field, therefore the lobe that represents it, extends sufficiently starting from the surface on which the same transmitter coil is placed.

During experiments it has been noticed that said field is still sufficiently intense at 50–60 cm from the transmitter coil to activate the transponder with which it has to interact. The receiver electrical coil is advantageous when it is multipolar to nullify or in any case to carry out a compensating action of the effects induced in it by the parasite magnetic fields that act on the entire transponder reader. Whereas the responding signal of the transponder is situated in a position that corresponds to a small portion of the receiver coil and produces an induced electromotive force which supplies the information relative to its contents when it is adequately amplified and demodulated with electronic systems of the known types. Said Rx receiver coil is usually shaped like a propeller on the elongated three dimensional small column shaped structure that supports it.

Figure 3:
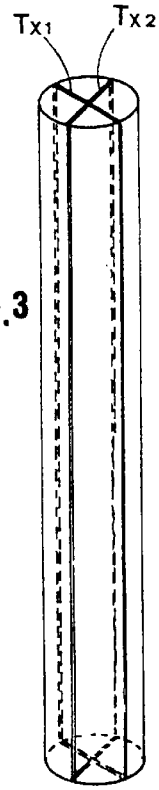
FIG. 3 is the perspective view of a supporting small column with two homopolar transmitter coils Tx1 and Tx2 which cross over each other.
Figure 6:
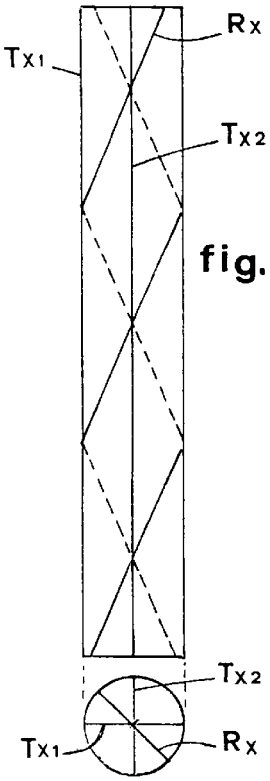
FIG. 6 reproduces the front view and layout of a supporting small column with two homopolar transmitter coils Tx1 and Tx2 in normal position and one multipolar receiver coil Rx.

The Tx transmitter group of the above mentioned transponder reader can be realised for example, with two homopolar coils that do not coincide, as exemplified in FIG. 3, or even with a number of distinct coils of more than two.

Figure 4:
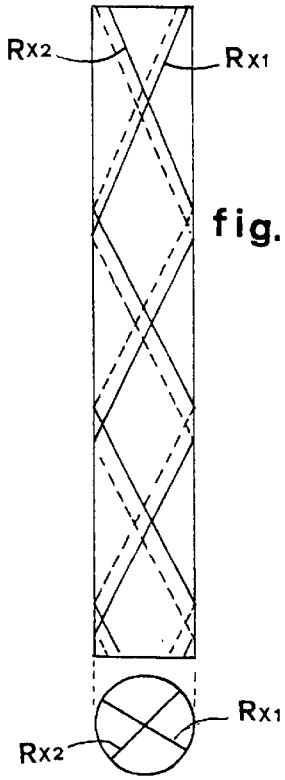
FIG. 4 is the front view and layout of a supporting small column with two multipolar receiver coils with a helix shape Rx1 and Rx2 that do not coincide.

In the same way the Rx receiver group can be realised with two multipolar coils that are offset in respect to each other, in an angular way and/or upwards and in any case in so as not to have them coinciding, as exemplified in FIG. 4, or having a higher number of said coils.

Figure 5:
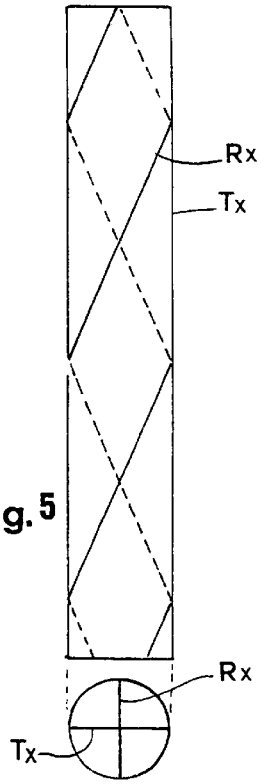
FIG. 5 reproduces the front view and layout of a supporting small column with a homopolar transmitter coil Tx and a multipolar receiver coil Rx.
Figure 7:
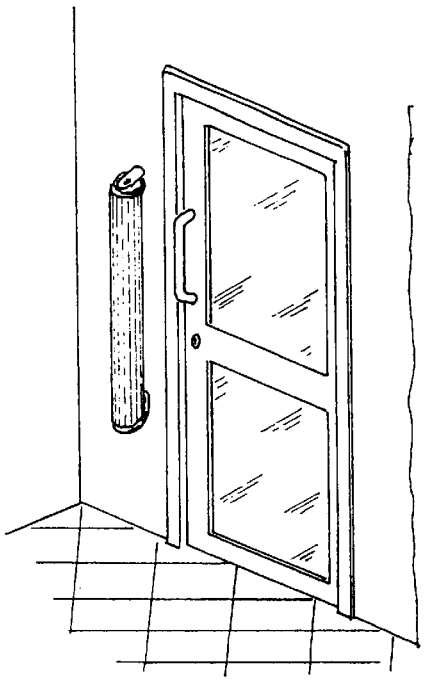
FIG. 7 reproduces the invention installed on the wall next to a controlled access door.
Figure 8:
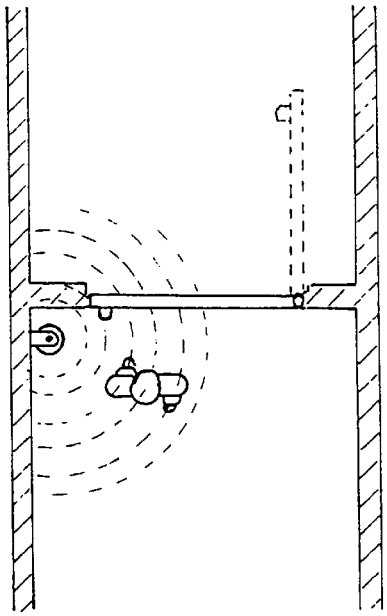
FIG. 8 shows the layout seen from above, of a corridor with a controlled access door, a transponder reader on the wall, and a person in transit.
Figure 10:
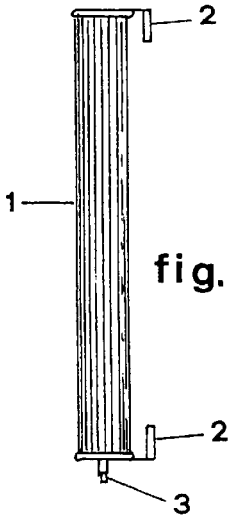
FIG. 10 is the front view, on a different scale, of the transducer equipped with wall mountings and with connectors for its external electrical connections.
Figure 9:
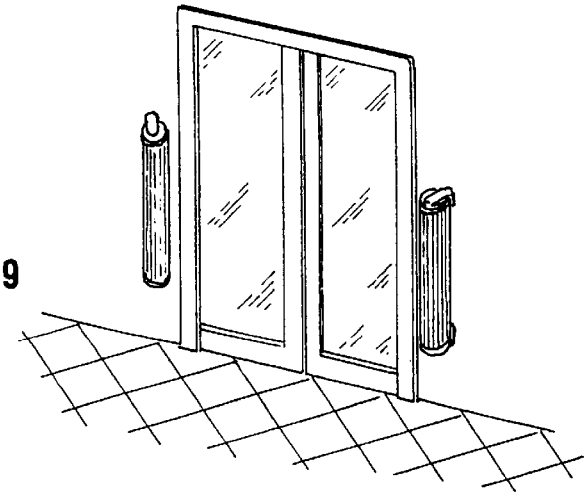
FIG. 9 shows a two-leaf door, combined with two separate transponder readers.

The transponder reader is generally realised with a single Tx transmitter coils and only one Rx receiver coil as exemplified in FIG. 5. In general it can be formed by the combination of one or more distinct homopolar electric transmitter coils, which are destined to be fed in phase or out of phase, and by one or more distinct multipolar electric receiver coils, which are destined to operate synchronised or unsynchronised to obtain both in transmission and in reception magnetic fields adequate for an improved detection of the transponder they are destined to.

What is claimed is:

1. A card transponder reading transducer for controlling passages by reading the contents of an inductive card transponder assigned to the people or objects transiting through the passages, comprising:

an elongated three-dimensional columnshaped structure (1) with circular or elliptic cross section for supporting a plurality of electric coils;

means (2) to anchor the elongated three-dimensional column-shaped structure to the floor, on the ceiling or on the wall near the passage to be controlled; and at least one transmitter (Tx) homopolar electric coil and at least on receiver (Rx) multipolar electric coils supported by the elongated three-dimensional column-shaped structure.

2. The card transponder reading transducer of claim 1, wherein the elongated column-shaped support structure is between 40 and 180 centimeters long.

3. The card transponder reading transducer of claim 1, wherein the elongated column-shaped supporting structure wherein said anchor means includes two end supports for securing the column-shaped supporting structure to a floor and/or to a ceiling.

4. The card transponder reading transducer of claim 1, wherein column-shaped supporting structure further includes a plurality of electric homopolar coils whose positions do not coincide.

5. The card transponder reading transducer of claim 1, wherein the column-shaped supporting structure further includes a plurality of electric multipolar receiver coils that are offset and whose positions do not coincide.

6. The card transponder reading transducer of claim 1, characterized by a column-shaped supporting structure wherein one or more distinct transmitter (Tx) homopolar electrical coils are combined with one or more distinct receiver (Rx) multipolar coils.

* * * * *